US010328733B2

(12) United States Patent
Yoda et al.

(10) Patent No.: US 10,328,733 B2
(45) Date of Patent: Jun. 25, 2019

(54) SUBLIMATION TYPE THERMAL TRANSFER SHEET

(71) Applicant: Dai Nippon Printing Co., Ltd., Tokyo (JP)

(72) Inventors: Shinya Yoda, Tokyo (JP); Emi Matsuba, Tokyo (JP); Junpei Oomura, Tokyo (JP); Kenzo Hayashi, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 15/553,322

(22) PCT Filed: Feb. 26, 2016

(86) PCT No.: PCT/JP2016/055911
§ 371 (c)(1),
(2) Date: Aug. 24, 2017

(87) PCT Pub. No.: WO2016/136977
PCT Pub. Date: Sep. 1, 2016

(65) Prior Publication Data

US 2018/0186159 A1 Jul. 5, 2018

(30) Foreign Application Priority Data

Feb. 26, 2015 (JP) ..... 2015-036777

(51) Int. Cl.
*B41M 5/395* (2006.01)
*B41M 5/382* (2006.01)
(Continued)

(52) U.S. Cl.
CPC ..... *B41M 5/38228* (2013.01); *B41J 31/00* (2013.01); *B41M 5/385* (2013.01);
(Continued)

(58) Field of Classification Search
CPC ..... B41M 5/34; B41M 5/345; B41M 5/382; B41M 5/38228; B41M 5/385; B41M 5/392; B41M 5/395; B41M 2205/02
(Continued)

(56) References Cited

U.S. PATENT DOCUMENTS

2007/0213218 A1 9/2007 Irita et al.
2009/0087598 A1 4/2009 Yokozawa
(Continued)

FOREIGN PATENT DOCUMENTS

JP H05-162473 A 6/1993
JP 06-320878 A1 11/1994
(Continued)

OTHER PUBLICATIONS

International Search Report and Written Opinion (Application No. PCT/JP2016/055911) dated Apr. 19, 2016.
(Continued)

*Primary Examiner* — Bruce H Hess
(74) *Attorney, Agent, or Firm* — Burr & Brown, PLLC

(57) ABSTRACT

A sublimation thermal transfer sheet having first, second, and third dye layers frame sequentially provided on a surface of a substrate in this order, and a back-face layer provided on another surface of the substrate. The first, second, and third dye layers contain an each individual sublimable dye and an each individual binder resin. One of the first and second dye layers further contains a releasing agent selected from a first group consisting of silicone oils, silicone-modified resins and phosphoric esters, and another dye layer further contains either one or both of at least a releasing agent selected from the first group and a cellulosic resin. The third dye layer (1) contains no releasing agent of the first group, or (2) contains the releasing agent at an
(Continued)

amount of not more than 0.3% by weight based on the total weight of the solid content of the third dye layer.

1 Claim, 1 Drawing Sheet

(51) Int. Cl.

| | |
|---|---|
| ***B41M 5/392*** | (2006.01) |
| ***B41J 31/00*** | (2006.01) |
| ***B41M 5/385*** | (2006.01) |
| *B41M 5/34* | (2006.01) |

(52) U.S. Cl.
CPC ..... *B41M 5/392* (2013.01); *B41M 5/395* (2013.01); *B41M 5/345* (2013.01); *B41M 2205/02* (2013.01); *B41M 2205/30* (2013.01); *B41M 2205/36* (2013.01)

(58) Field of Classification Search
USPC ..... 503/227
See application file for complete search history.

(56) References Cited

U.S. PATENT DOCUMENTS

| | | | |
|---|---|---|---|
| 2009/0189968 | A1 | 7/2009 | Yokozawa |
| 2014/0267535 | A1 | 9/2014 | Yoneyama et al. |

FOREIGN PATENT DOCUMENTS

| | | | |
|---|---|---|---|
| JP | H07-214924 | A | 8/1995 |
| JP | 2007-237613 | A1 | 9/2007 |
| JP | 2008-246777 | A1 | 10/2008 |
| JP | 2009-083279 | A1 | 4/2009 |
| JP | 2009-178936 | A1 | 8/2009 |
| JP | 2013-082212 | A1 | 5/2013 |

OTHER PUBLICATIONS

Extended European Search Report, European Application No. 16755721.4, dated Oct. 19, 2018 (7 pages).

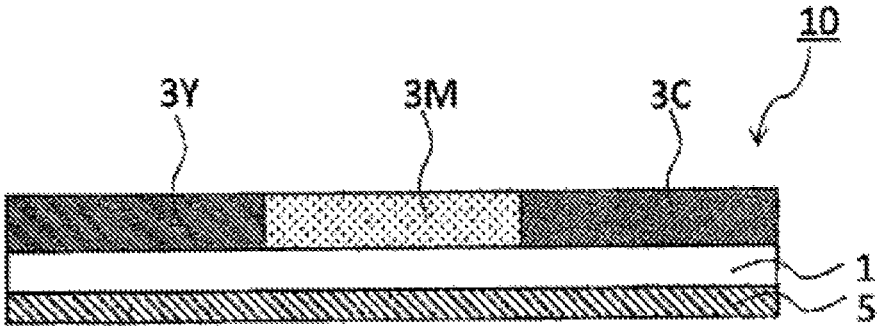
10
3Y
3M
3C
1
5

SUBLIMATION TYPE THERMAL TRANSFER SHEET

BACKGROUND OF THE INVENTION

1. Field of the Invention

The present invention relates to a sublimation type thermal transfer sheet.

2. Description of Related Art

As simple printing methods, various thermal transfer recording methods have been widely used. In each thermal transfer recording method, when a color image is to be obtained, a thermal transfer sheet in which color material layers of, for example, yellow, magenta and cyan (if necessary, and black) are repeatedly and numerously provided on a continuing substrate 1 so as to the colorant layers are layered in parallel on the substrate across the surface of the substrate, as being frame sequentially, has been mainly used. The thermal transfer method may be broadly divided into two methods, i.e., melt-transfer method and sublimation transfer method. The melt-transfer method is an image forming method wherein colorant layers which are melted and softened by heating are transferred onto a thermal transfer receiving sheet in order to form an image, and the sublimation transfer method is an image forming method wherein sublimation dyes in the colorant layers are transferred onto a transfer receiving article by heating in order to form an image. Particularly, with respect to the sublimation transfer method, since the transferring amount of dye can be controlled by the amount of energy applied to the thermal transfer sheet, it is possible to control concentration graduation. Therefore, this method can form a high quality image in which the image is very sharp, and excels in the transparency, the reproducibility of neutral tints and the gradation, and thus, the image is comparable to a full-color photographic image.

Although the sublimation transfer method is excellent in the formation of gradation image as mentioned above, the obtained image has disadvantages of a poor durability, since sublimation dyes to be used for forming the image have relatively low molecular weights and they does not have a vehicle. Therefore, recently, in order to improve the durability of an image, attempts have been widely performed, in which a protective layer is transferred on the image formed by the sublimation transfer method During the image formation using the above-mentioned sublimation thermal transfer method, if the releasability between the dye layer of the thermal transfer sheet and the receiving layer of the thermal transfer image receiving sheet is low, the dye layer of the thermal transfer sheet is stuck to the receiving layer of the thermal transfer image receiving sheet, and thus, problems such as generation of peeling noise, running failure, generation of peeling line and the like may occur when the dye layer is peeled off from the receiving layer after image formation. In addition to this, there may be a problem of abnormal transfer in which a dye layer sticks to the receiving layer and the dye layer is transferred as an intact layer onto the receiving layer.

On the other hand, in the case that the protective layer is transferred onto the image formed by the sublimation thermal transfer method in order to impart durability to the image, if the adhesiveness between the formed image and the protective layer is low, there may be a problem that a part or all of the protective layer transferred onto the image may be peeled off.

In order to improve the releasability between the dye layer and the receiving layer, it has been said that it is preferable to incorporate various releasing agents into the dye layer of the thermal transfer sheet or the receiving layer of the thermal transfer image receiving sheet. For example, in Patent Literature 1, a thermal transfer sheet in which a silicone resin as a releasing agent is contained in at least one layer of a yellow dye layer, a magenta dye layer, and a cyan dye layer is proposed. Also, in the same document, various embodiments of the releasing agent to be contained in each dye layer have been proposed, such as an embodiment in which the content of the releasing agent is changed by each dye layer, and an embodiment in which the content of the releasing agent is increased as the printing order of the dye layer to be printed becoming later, that is, the embodiment in which the releasing agent is contained in each dye layer so that the contents of the releasing agent in the dye layers satisfy the relation of the yellow dye layer<the magenta dye layer<the cyan dye layer. Further, this document also proposes zinc stearate, stearic acid amide, silicone oil, silicone resin, silicone modified resin, and the like as examples of the releasing agent that can be contained in a dye layer in addition to the silicone resin.

However, in the case of forming a superimposed image in which a yellow image, a magenta image and a cyan image are superimposed on each other by using a thermal transfer sheet as proposed in the Patent Literature 1, if the thermal transfer sheet to be used contains the above-mentioned releasing agent or the like in all of the dye layers, an image to be formed lastly in a superimposed manner (for example, a cyan image formed using a cyan dye layer) is forced to contain the releasing agent. In general, a releasing agent excellent in releasability tends to obstruct the adhesion of a protective layer at the time of transferring it onto an image. When the releasing agent is added to each dye layer for the purpose of improving releasability simply, the releasability can be sufficiently satisfied while the adhesion between the image and the protective layer is low when the protective layer is transferred onto the formed image. In other words, with respect to the dye layers, it can be said that there is a trade-off relationship between the improvement of the releasability from the receiving layer and the improvement of the adhesion of the image formed by using the dye layer to the protective layer. In particular, in the case where the content of the releasing agent is increased as the dye layer to be printed later, as suggested as a preferable embodiment in Patent Literature 1, when a superimposed image is formed by transferring the respective sublimable dyes of the dye layers in the order, the image superposed lastly is forced to contain the releasing agent in large quantity, and thus, it is more difficult to sufficiently satisfy adhesion between the image and the protective layer.

PRIOR ART DOCUMENTS

Patent Literature

Patent Literature 1: JP 2008-246777 A

SUMMARY OF THE INVENTION

Problems to be Solved by the Invention

The present invention is the one contrived in such a situation, and a main purpose of the present invention is to provide a sublimation type thermal transfer sheet capable of forming an image having good adhesion to the protective layer while the releasing property during image formation is good.

Means for Solving the Problem

The present invention for solving the above-mentioned problems is embodied as a sublimation type thermal transfer sheet in which a first dye layer, a second dye layer, and a third dye layer are frame sequentially provided on a surface of a substrate in this order, and a back-face layer is provided on another surface of the substrate, wherein the first dye layer, the second dye layer, and the third dye layer contain an each individual sublimable dye and an each individual binder resin, and one of the first dye layer and the second dye layer further contains at least a releasing agent selected from a first group consisting of silicone oils, silicone-modified resins and phosphoric esters, another of the first dye layer and the second dye layer further contains either one or both of at least a releasing agent selected from the first group and a cellulosic resin, and the third dye layer (1) contains no releasing agent of the first group, or (2) contains a releasing agent of the first group at an amount of not more than 0.3% by weight based on the total weight of the solid content of the third dye layer.

The third dye layer may contain a cellulosic resin. The cellulosic resin may be an alkyl cellulose resin In addition, both dye layers of the first dye layer and the second dye layer may contain at least one member selected from the first group.

Alternatively, a dye layer of either one of the first dye layer and the second dye layer may contain at least one member selected from the first group, and the other dye layer may contain the cellulosic resin.

The first dye layer may be a yellow dye layer, the second dye layer may be a magenta dye layer, the third dye layer may be a cyan dye layer.

Effects of the Invention

According to the sublimation type thermal transfer sheet of the present invention, it becomes possible to obtain a good releasing property during image formation, and to form an image having good adhesion to the protective layer.

BRIEF DESCRIPTION OF DRAWINGS

FIG. 1 is a schematic sectional view showing an embodiment of a sublimation type thermal transfer sheet according to the present invention.

DETAILED DESCRIPTION OF THE INVENTION

Now, a sublimation type thermal transfer sheet 10 according to an embodiment of the present invention (hereinafter referred to as "thermal transfer sheet 10 of one embodiment") is specifically described with reference to the drawings. As shown in FIG. 1, the thermal transfer sheet 10 of one embodiment has a constitution in which a first dye layer (3Y), a second dye layer (3M), and a third dye layer (3C) are frame sequentially provided on a surface of a substrate 1 in this order, and a back-face layer 5 is provided on another surface of the substrate 1. The first dye layer (3Y), the second dye layer (3M), and the third dye layer (3C) contain an each individual sublimable dye and an binder resin, and the sublimable dyes contained in the dye layers are different in color from each other for the dye layer.

In an image forming process using the thermal transfer sheet 10 of one embodiment, it is assumed that the printing is performed in the order of the first dye layer (3Y), the second dye layer (3M), and the third dye layer (3C). In addition, the thermal transfer sheet of one embodiment is a sublimation type thermal transfer sheet used in a sublimation type thermal transfer system, and the sublimation type thermal transfer system is a thermal transfer system in which a sublimable dye contained in a dye layer of a sublimation type thermal transfer sheet is transferred to a receiving layer of a thermal transfer image receiving sheet in order to form an image.

Then, assuming a first group consists of silicone oils, silicone-modified resins and phosphoric esters, the thermal transfer sheet 10 of one embodiment is characterized in that the first dye layer (3Y) and the second dye layer (3M) contain one of at least a releasing agent selected from the first group and a cellulosic resin, or both of them, individually, and the third dye layer (1) contains no releasing agent of the first group, or (2) contains a releasing agent of the first group at an amount of not more than 0.3% by weight based on the total weight of the solid content of the third dye layer. In other words, the third dye layer (3C) may contain a releasing agent of the first Group at an amount in the range of 0% by weight to not more than 0.3% by weight based on the total weight of the solid content of the third dye layer.

According to the thermal transfer sheet of one embodiment having the above characteristics, in combination with the thermal transfer sheet and a thermal transfer image-receiving sheet, it is possible to make the releasability between a dye layer and the receiving layer or any previously formed image satisfactory, even in any of the image forming stages of: a primary color image forming step where the sublimable dye contained in the first dye layer is transferred onto the receiving layer of the thermal transfer image-receiving sheet in order to forma "primary color image"; a secondary color image forming step where the sublimable dye contained in the second dye layer is transferred onto the "primary color image" in order to form a "secondary color image"; and a tertiary color image forming step where the sublimable dye contained in the third dye layer is transferred onto the "secondary color image" in order to form a "tertiary color image". Furthermore, it is possible to form a "tertiary color image" having good adhesion to a protective layer, a thermally meltable ink, or a transferred object (hereinafter mainly described about the protective layer).

The thermal transfer sheet of one embodiment has an essential condition that, assuming a first group consists of silicone oils, silicone-modified resins and phosphoric esters (hereinafter, the silicone oils, and silicone-modified resins and phosphoric esters may be sometimes collectively referred to as "releasing agent(s) of the first group"), one of the first dye layer (3Y) and the second dye layer (3M) contains the releasing agent of the first group, and another of the first dye layer and the second dye layer contains either one or both of the releasing agent of the first group and a cellulosic resin. That is, the thermal transfer sheet 10 of one embodiment can be roughly divided into the following three modes.

First mode: both of the first dye layer (3Y) and the second dye layer (3M) contain the releasing agent of the first group individually.

Second mode: the first dye layer (3Y) contains the releasing agent of the first group, and and the second dye layer (3M) contains the cellulosic resin.

Third mode: the first dye layer (3Y) contains the cellulosic resin, and and the second dye layer (3M) contains the releasing agent of the first group.

Also, these various modes can be combined. Concretely, it is possible that the first dye layer (3Y) and/or the second dye layer (3M) contains both of the releasing agents of the first group and the cellulosic resin.

As described above, in the thermal transfer sheet 10 of one embodiment, since one of the first dye layer (3Y) and the second dye layer (3M) contains the releasing agent of the first group, and another of the first dye layer and the second dye layer contains either one or both of the releasing agent of the first group and a cellulosic resin, it become possible to improve the releasability of the dye layer at the "primary color image" formation and at the "secondary color image" formation. Further, when the releasing agent of the first group is included in the "secondary color image", it is further possible to improve the releasability of the dye layer at the "tertiary color image" formation.

Specifically, any of the silicone oils, the silicone-modified resins, and phosphoric esters as the releasing agent of the first group can impart an extremely good releasing property to the dye layer, and further, any of the releasing agents has a property that it is easily transferred to an opposite article in conjunction with the sublimable dye when the image is formed by using a dye layer which contains the releasing agent of the first group.

Therefore, according to the thermal transfer sheet 10 of the first mode or the second mode where the first dye layer (3Y) contains the releasing agent of the first group, when the "primary color image" is formed, the releasing agent of the first group can be included in the "primary color image". The releasing agent of the first group which is thus contained in the "primary color image" formed in advance can play a supplementary role to aid the releasability when forming the "secondary color image". Therefore, when a "secondary color image" is formed, the releasing agent of the first group contained in the "primary color image" acts in conjunction with the releasing agent contained in the second dye layer (3M), the releasability between the "primary color image" and the second color layer (3M) can be made more excellent. Further, when the first dye layer (3Y) contains the releasing agent of the first group, the releasing agent of the first group can be also remained in the "secondary color image". The releasing agent of the first group which is thus remained in the "secondary color image" can play a supplementary role to aid the releasability when forming the "tertiary color image". Thus, as compared with a case that the releasing agent of the first group is not included in the "secondary color image", the releasability between the "secondary color image" and the third color layer (3C) can be made more excellent when forming the "tertiary color image" in this case.

In particular, according to the thermal transfer sheet 10 of the first mode where both of the first dye layer (3Y) and the second dye layer (3M) individually contain the releasing agent of the first group, it is possible to provide the releasing agent of the first group into the "primary color image", and it is further possible to provide the releasing agent of the first group which is contained in the second dye layer (3M), in addition to the releasing agent of the first group which is contained in the "primary color image", into the "secondary color image". Thus, according to this mode, the releasability between the "primary color image" and the second dye layer (3M) can be made more excellent when forming the "secondary color image". Furthermore, in the thermal transfer sheet 10 of this first mode, since the second dye layer (3M) also contains the releasing agent of the first group, the releasing agent of the first group can be positioned at the surface of the "secondary color image" with a larger amount when forming the "secondary color image". The larger the amount of the releasing agent located at the surface of the image, the more auxiliary effect for supplementing the releasability can be obtained when forming the next image. Therefore, according to the thermal transfer sheet of the first mode, it is possible to improve the releasability between the "secondary color image" and a third dye layer (30) satisfactory•when forming the "tertiary dye layer".

On the other hand, with respect to the thermal transfer sheet of the third form, since the first dye layer (3Y) does not contain the releasing agent of the first group, it is impossible to provide the releasing agent of the first group into the "primary color image". With respect to the thermal transfer sheet of the third form, however, the second dye layer (3M) to be used for forming the "secondary color image" contains the releasing agent of the first group which excels in the releasing property. Therefore, by virtue of the function of the releasing agent of the first group which is contained in the second dye layer (3M), the releasability between the "primary color image" and the second dye layer (3M) can be made excellent when forming the "secondary color image". The releasing agent of the first group included in the second dye layer (3M) is likely to be positioned on the surface of the "secondary color image" to be formed. Therefore, assuming that the amount of the releasing agent of the first group which is contained in the second dye layer (3M) in the third form and the amount of the releasing agent which is contained in that contained in the first dye layer (3Y) in the second mode are the same, it is likely that the "secondary color image" formed by the thermal transfer sheet of the third mode is superior to the "secondary color image" formed by the thermal transfer sheet of the second mode with respect to the amount of the releasing agent of the first group located on the surface of the formed color image. As the amount of the releasing agent of the first group located on the surface of the "secondary color image" increases, the releasability on forming the "tertiary color image" tends to be improved. Thus, in this respect, the thermal transfer sheet of the third form is a preferred form of the thermal transfer sheet.

In other words, according to the thermal transfer sheets of the first, second and third forms, since a "primary color image" including the releasing agent of the first group can be formed, or even when a "primary color image" which does not include the releasing agent of the first group is formed, since the releasing agent of the first group is contained in the second dye layer (3M) for forming a "secondary color image", it becomes possible to make the releasability between the "primary color image" and the second dye layer (3M) on forming the "tertiary color image" excellent. Further, according to the thermal transfer sheets of the first, second and third forms, since the releasing agent of the first group is also contained in the "secondary color image", the releasability between the "secondary color image" and the third color layer (3C) on forming the "tertiary color image" can be made more excellent by virtue of the presence of this releasing agent of the first group, as compared with a case that the releasing agent of the first group is not included in the "secondary color image". In addition, since the first dye layer (3Y) includes the releasing agent of the first group (in the case of the above-mentioned first and second modes)

which exhibits a good releasability or the cellulosic resin (in the case of the above-mentioned third mode) which can impart a releasability to the dye layer, it is also possible to satisfy the releasability between the receiving layer and the first dye layer (3Y) on forming the "primary color image".

Here, the detailed mechanism is not elucidated well. However, for instance, if the second dye layer (3M) of the thermal transfer sheet of the second form, or the first dye layer (3Y) of the thermal transfer sheet of the third form is allowed to contain any resin other than the cellulosic resin, such as a polyvinyl acetal resin or a polyvinyl butyral resin, etc., without containing the cellulosic resin, it is impossible to sufficiently satisfy the releasability when forming the "secondary color image" or the "tertiary color image".

The silicone oil, which is one of the releasing agent of the first group used herein, denotes a compound which has siloxane bond(s) in its molecular structure.

The silicone-modified resin, which is another one of the releasing agent of the first group used herein, denotes a resin which has polysiloxane group(s) in a part of the molecule thereof, for example, it may be prepared by copolymerization of a polysiloxane group-containing vinyl monomer and another type of vinyl monomer, or reaction of a thermoplastic resin with a reactive silicone, or the like.

As the silicone-modified resin, for instance, products prepared by block copolymerizing a thermoplastic resin and a polysiloxane group-containing vinyl monomer, products prepared by graft copolymerizing a thermoplastic resin and a polysiloxane group-containing vinyl monomer, and products prepared by reacting a thermoplastic resin with a reactive silicone, may be enumerated. As the thermoplastic resin which constitutes the silicone-modified resin, for instance, acrylic resins, polyurethane resins, polyester resins, epoxy resins, polyacetal resins, polycarbonate resins, polyimide resins, etc., may be enumerated. Among them, the acrylic resins, the polyurethane resins, the polyester resins, and the polyacetal resins and the like are preferable.

Here, the reactive silicone denotes a compound which has a polysiloxane structure in a main chain, and also has reactive functional group(s) capable of reacting with a functional group of the thermoplastic resin at one end or both ends thereof. As the reactive functional group, for instance, an amino group, a hydroxyl group, an epoxy group, a vinyl group, a carboxyl group, and the like, may be enumerated.

The phosphoric acid ester, which is also one of the releasing agent of the first group used herein, denotes an ester which is obtained by dehydration condensation of a phosphoric acid and an alcohol, among organic phosphoric compounds. As the phosphoric acid ester, for example, (1) phosphoric acid monoesters or diesters of saturated or unsaturated higher alcohols having a carbon number of 6-20; (2) phosphoric acid monoesters or diesters of polyoxyalkylene alkyl ethers or polyoxyalkylene alkyl allyl ethers; (3) phosphoric acid monoesters or diesters of alkylene oxide adducts of above-mentioned saturated or unsaturated higher alcohols (average addition molar number: 1-8); (4) phosphoric acid monoesters or diesters of alkylphenols or alkylnaphthols having an alkyl group having a carbon number of 8-12; and the like may be enumerated. As the saturated or unsaturated higher alcohol in above-mentioned compounds (1) and (3), for instance, cetyl alcohol, stearyl alcohol, and oleyl alcohol and the like may be enumerated. As the alkylphenol in above-mentioned compound (3), for instance, nonylphenol, dodecylphenol, and diphenylphenol and the like may be enumerated. The coating liquid according to the present invention may contain only one kind of phosphoric acid ester, or may contain two or more kinds of phosphoric acid esters.

As an example, a phosphoric diester represented by the following general formula (i) or phosphoric monoester represented by the following general formula (ii), or a mixture thereof, may be enumerated.

General formula (i)

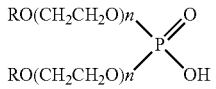

wherein each R is an alkyl group having 1-6 carbon atom(s), and each n is a number of 1-6.

General formula (ii)

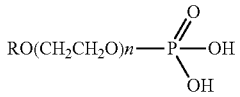

wherein R is an alkyl group having 1-6 carbon atom(s), and n is a number of 1-12.

As the cellulosic resin, for example, cellulose acetate resins, cellulose acetate butyrate resins, cellulose acetate propionate resins, cellulose acetate resins, nitrocellulose resins, alkyl cellulose resins, and hydroxy cellulose resins, and the like may be enumerated. Among them, the alkyl cellulose resins, especially the ethyl cellulose resins, are preferable, since they can impart a high releasability to a dye layer as compared with the other cellulosic resins.

Paying attention to the releasability when forming the "tertiary color image" by overlapping the formed images, the releasability of the dye layer at the time for forming the "secondary color image" or "tertiary color image" tends to be lower than the releasability of the dye layer at the time for forming the "primary color image". This is because at the time of the first image formation, that is, at the step of forming the "primary color image", it is presumed that the releasability between the first dye layer and the receiving layer of the thermal transfer sheet can be satisfied to some extent, even if the receiving layer of the thermal transfer sheet is not plasticized and the first dye layer does not contain a releasing agent. On the other hand, the sublimable dye transferred to the receiving layer side, that is, the image previously formed, and, the dye layer of the thermal transfer sheet is poor in compatibility with the releasability. Thus, when any countermeasure for improving the releasability is not applied to the respective dye layers, it is impossible to satisfy the releasability between the "primary color image" and the second dye layer (3M) on forming the "secondary color image". Similarly, it is also impossible to satisfy the releasability between the "secondary color image" and the third dye layer (3C) on forming the "tertiary color image".

There is no particular limitation about the content of the releasing agent of the first group in the first dye layer (3Y) of the thermal transfer sheet of above-mentioned second mode, and in the second dye layer (3M) of the thermal transfer sheet of above-mentioned third mode, and the content can be appropriately set in accordance with a migration amount of the releasing agent of the first group to be incorporated in the "secondary color image". In the case of further improving the releasability and the adhesiveness to a protective layer, it is preferable that the total weight of the releasing agent of the first group is in the range of not less than 0.5% and not more than 20% by weight on the basis of the total weight of the solid content of the dye layer(s) which contains the releasing agent of the first group. By setting the content in the preferable range, it becomes possible to incorporate a sufficient amount of the releasing agent of the first group into the "secondary color image" and thus, it is possible to make the releasability on forming the "tertiary color image" better. In addition, the adhesiveness between the "tertiary color image" and the protective layer can be made more satisfactory. Furthermore, the adhesiveness between the "primary color image", which is formed by using either the first dye layer (3Y) or the second dye layer (3M), and the protective layer can be also made more satisfactory.

Although there is no particular limitation about the content of the cellulosic resin in the second dye layer (3M) of the thermal transfer sheet of above-mentioned second mode, and in the first dye layer (3Y) of the thermal transfer sheet of above-mentioned third mode, it is preferable that the content of the cellulosic resin is in the range of not less than 2% and not more than 50% by weight on the basis of the total weight of the solid content of the dye layer which contains the cellulosic resin. If the content is less than 2% by weight, the releasability of the dye layer containing the cellulosic resin may tend to be deteriorated. On the other hand, if the content exceeds 50% by weight, depending on the contents of the other optional ingredients, there is a possibility that the content of the sublimable dye may become too low, and the density of the formed image may tend to decrease. Further, precipitation of the dye may be easily generated, a tendency that dye adhesion to the non-printing area is likely to occur may arise. From such viewpoints, a particularly preferable content of the cellulosic resin is not more than 30% by weight, and more desirably, not more than 10% by weight, on the basis of the total weight of the solid content of the second dye layer (3M) of the thermal transfer sheet of the second mode, or the first dye layer (3Y) of the thermal transfer sheet of the third mode.

On the other hand, in the case of the thermal transfer sheet 10 of the first mode, the amount of the releasing agent of the first group included in the first dye layer (3Y) and the second dye layer (3M) can be determined appropriately in consideration of the total amount which consists of: an amount of the releasing agent of the first group that is transferred from the first dye layer (3Y) and finally incorporated in the "secondary color image"; and an amount of the releasing agent of the first group that is transferred from the second dye layer (3M) and incorporated in the "secondary color image". In the case of further improving the releasability and the adhesiveness to a protective layer, it is preferable that the total weight of the releasing agent of the first group contained in both dye layers is in the range of not less than 0.5% and not more than 20% by weight on the basis of the total weight of the solid content of the first dye layer (3Y) and the second dye layer (3M). Particularly, it is preferable that the content of the releasing agent of the first group is in the range of not less than 0.5% and not more than 20% by weight on the basis of the total weight of the solid content of the first dye layer (3Y), and the content of releasing agent of the first group is in the range of not less than 0.5% and not more than 20% by weight on the basis of the total weight of the solid content of the second dye layer (3M). According to a thermal transfer sheet of the preferred embodiment of the first mode, it is possible to make the releasability on forming the "tertiary color image" more satisfactory. In addition, the adhesiveness between the "tertiary color image" and the protective layer can be made more satisfactory. Furthermore, the releasability on forming the "primary color image", and on forming the "secondary color image", as well as the adhesiveness between the "primary color image", or "secondary color image" and the protective layer can be also made more satisfactory.

The second dye layer (3M) of the thermal transfer sheet of the second mode, and/or the first dye layer (3Y) of the thermal transfer sheet of the third embodiment, may use the cellulosic resin alone as the binder resin, alternatively, they may use the cellulosic resin in combination with any other binder resin(s). In the case of using it in combination with other binder resin(s), in order to improve the surface quality of the second dye layer (3M) of the thermal transfer sheet of the second mode, or of the first dye layer (3Y) of the thermal transfer sheet of the third mode, for example, it is preferable to use a polyvinyl butyral resin in the combination.

The polyvinyl butyral resin used herein denotes the resin obtained by acetalizing a polyvinyl alcohol resin with butyl aldehyde, and in the acetalized structural unit, the ratio of the butyral group is high, and the butyralized degree to the total acetalized degree (butyralized/total acetalized), in other words, the ratio of the number of moles of the butyralized structural unit using butyl aldehyde to the total number of moles of the acetalized structural unit, is not less than 50% and not more than 100%. A preferred polyvinyl butyral resin has a butyralizated degree of not less than 60%.

The first dye layer (3Y) and/or the second dye layer (3M) of the thermal transfer sheet in above-mentioned various modes may contain any other releasing agent(s) in addition to the releasing agent of the first group and/or the cellulosic resin. As the other releasing agents, for example, solid waxes such as polyethylene waxes, amide waxes, Teflon® waxes, and fluorine-based surfactants and the like may be enumerated.

Incidentally, by including the releasing agent of the first group into the dye layer, the releasing agent can bring an advantage that the releasability from the receiving layer or the formed image becomes an extremely preferable one, while the adhesion between the image and the protective layer is impaired when the protective layer is transferred onto the protective layer. In the thermal transfer sheet of one embodiment, since the image formed by using the third dye layer (3 C) is located at the top face of the "tertiary color image", a large quantity of the releasing agent of the first group may locate at the top face of the "tertiary color image" when the releasing agent of the first group is provided in the third color layer (3C) with a large quantity. Thus, when a protective layer is transferred onto the "tertiary color image", it may become difficult to satisfy the adhesiveness between the "tertiary color image" and the protective layer sufficiently.

Thus, with respect to the thermal transfer sheet of one embodiment, conditions that (1) the third dye layer (3C) contains no releasing agent of the first group, or that (2) even if the third dye layer (3C) contains the releasing agent of the first group, the amount of the releasing agent is not more than 0.3% by weight based on the total weight of the solid content of the third dye layer, is required. According to the third dye layer (3C) which satisfies any of the conditions (1) and (2), when the "tertiary color image" is formed, it can be attained that the releasing agents of the first group is not present on the top face of the "tertiary color image", or even if it present, the amount thereof can be made small. In other words, according to the thermal transfer sheet of this embodiment, it becomes possible to forma "tertiary color image" having good adhesion to the protective layer.

In the above condition (2), the content of the releasing agent of the first group is set to be not more than 0.3% by weight based on the total weight of the solid content of the third dye layer (3C). This is because, if the content of the releasing agent of the first group exceeds 0.3% by weight, the adhesiveness between the "tertiary color image" and the protective layer becomes lower when the protective layer is transferred onto the "tertiary color image".

With respect to a thermal transfer sheet 10 according to a more preferred embodiment, the third dye layer which satisfies the above condition (1) or (2) contains a cellulosic resin. The cellulosic resin itself acts as a resin capable of giving a releasing property to the dye layer; and since the cellulosic resin is not transferred to the "tertiary color image" side, that is, to the receiving layer side when forming the "tertiary color image", it does not impair the adhesion between the "tertiary color image" and the protective layer when transferring the protective layer onto the "tertiary color image", and thus the cellulosic resin is preferable. For the same reason as described above, an alkyl cellulose resin, especially an ethyl cellulose resin is preferable as the cellulosic resin.

The content of the cellulosic resin in the case where the cellulosic resin is contained in the third dye layer (3C) is preferably to be not less than 2% by weight and not more than 50% by weight on the basis of the total weight of the solid content of the third dye color layer (3C). If the amount is less than 2% by weight, the releasability of the dye layer containing the cellulosic resin may tend to be deteriorated. On the other hand, if the content exceeds 50% by weight, there is a possibility that the content of the sublimable dye may become lower, and the density of the formed image may tend to decrease. Further, precipitation of the dye may be easily generated, a tendency that dye adhesion to the non-printing area is likely to occur may arise. From such viewpoints, a particularly preferable content of the cellulosic resin is not more than 30% by weight, and more desirably, not more than 10% by weight, on the basis of the total weight of the solid content of the third dye layer (3C).

The cellulosic resin may be used alone as the binder resin in the third dye layer, alternatively, it may be used in combination with any other binder resin(s). Particularly, when the containing amount of the cellulosic resin to the total weight of the binder resin is increased, it becomes possible to improve the releasability of the third dye layer (3C) and thus it is preferable. More preferably, the content of the cellulosic resin is to be not less than 5% by weight on the basis of the total weight of the binder resin.

When the third dye layer (3C) contains the cellulosic resin, in order to improve the surface quality of the third dye layer (3C), for example, it is preferable to use a polyvinyl butyral resin in the combination.

Separately, instead of including the cellulosic resin in the third dye layer (3C) or in addition to the inclusion of the cellulosic resin to the third dye layer (3C), by including releasing agent(s) other than the releasing agents of the first group, it is possible to further improve the releasability between the "secondary color image" and the third dye layer (3C). As the releasing agent other than the releasing agent of the first group, the "other releasing agents" and the like described above can be used with an appropriately selection. Among them, since the wax-based releasing agent or the like is not transferred to the "tertiary color image" side, that is, to the receiving layer side when forming the "tertiary color image" with using the third dye layer (3C), it does not impair the adhesion between the "tertiary color image" and the protective layer when transferring the protective layer onto the "tertiary color image", and thus the wax-based releasing agent is preferable.

In the case of including releasing agent(s) other than the releasing agents of the first group, instead of including the cellulosic resin in the third dye layer (3C), the preferable content of the releasing agent(s) other than the releasing agents of the first group is in the range of not less than 2% by weight and not more than 50% by weight on the basis of the total weight of the solid content of the third dye layer.

To summarize the above, the thermal transfer sheet 10 of the first mode, the second mode, or the third mode can make the releasability between the "primary color image" and the second dye layer (3M) when forming the "secondary color image" better by virtue of the releasing agent of the first group which is contained in the previously formed "primary color image". Further, when satisfying the above condition (1) or (2), the deficiency of the releasability possessed by the third dye layer (3C) itself can be supplemented with the releasing agent of the first group which is included in the "secondary color image", and thus it can make the releasability between the "secondary color image" and the third dye layer (3C) when forming the "tertiary color image" better. Particularly, among them, the thermal transfer sheet 10 of the third mode is a more preferable embodiment, since it brings an excellent releasability when forming the "primary color image", the "secondary color image", and the "tertiary color image", and an excellent adhesiveness between the "tertiary color image" and the protective layer.

Next, each dye layer constituting the thermal transfer sheet of one embodiment will be described with referring to examples. In the general sublimation type thermal transfer sheet, a yellow dye layer, a magenta dye layer, and a cyan dye layer are provided in this order on the same surface of a substrate in accordance with the frame sequential method, and the printing is performed in the order of yellow, magenta, and cyan.

In the following explanation of the respective dye layers, a case in which the first dye layer (3Y) is a yellow dye layer containing a yellow sublimable, the second dye layer (3M) is a magenta dye layer containing a magenta sublimable dye, and the third dye layer (3C) is a cyan dye layer containing a cyan sublimable will be described as an example. However, the arrangement of the dye layers in the thermal transfer sheet 10 according to one embodiment is provided is not limited to this example case, any arrangement can be taken whenever the necessity arises. For instance, the first dye layer (3Y) may be a magenta dye layer or a cyan dye layer, and the second dye layer (3M) may be a yellow dye layer or a cyan dye layer, and the third dye layer (3C) may be a yellow dye layer or a magenta dye layer. Further, All or a part of the yellow dye layer, the magenta dye layer and the cyan dye layer can be replaced with any other dye layer of an arbitrary hue.

(Yellow Dye Layer, Magenta Dye Layer, and Cyan Dye Layer)

The yellow dye layer as the first dye layer (3Y) may contain a yellow sublimable dye, a binder resin and a releasing agent of the first group as a releasing agent, or a cellulosic resin as a releasing agent. The magenta dye layer as the second dye layer (3M) may contain a magenta sublimable dye, a binder resin, and a releasing agent of the first group as a releasing agent, or a cellulosic resin as a releasing agent. The cyan dye layer as the third dye layer (3C) may contains a cyan sublimable dye, and a binder resin. In this situation, any one dye layer of the yellow dye layer and the magenta dye layer must contain the releasing agent of the first group, and another dye layer of the yellow dye layer and the magenta dye layer contains both of or either one of the first group of releasing agent and the cellulosic resin. The cyan dye layer (1) contains no releasing agent of the first group, or (2) contains the releasing agent of the first group at an amount of not more than 0.3% by weight based on the total weight of the solid content of the third dye layer even when the first group of releasing agents is contained/

Although the sublimable dye contained in each dye layer is not particularly limited, it is preferable to have a sufficient coloring density, and does not fade due to light, heat, temperature or the like. As the sublimable dye, for instance, diarylmethane based dyes; triarylmethane based dyes; thiazole based dyes; merocyanine dyes; pyrazolone dyes; methine based dyes; indoaniline based dyes; azomethine dyes such as acetophenone azomethine dyes, pyrazolo azomethine dyes, imidazol eazomethine dyes, imidazo azomethine dyes, and pyridone azomethine dyes; xanthene based dyes; oxazine based dyes; cyanostyrene based dyes such as dicyanostyrene dyes and tricyanostyrene dyes; thiazine based dyes; azine based dyes; acridine based dyes; benzeneazo based dyes; azo based dyes such as, pyridoneazo dyes, thiopheneazo dyes, isothiazoleazo dyes, pyrroleazo dyes, pyrazoleazo dyes, imidazoleazo dyes, thiadiazoleazo dyes, triazoleazo dyes, and disazo dyes; spiropyran based dyes; indolinospiropyran based dyes; fluoran based dyes; rhodaminelactam based dyes; naphthoquinone based dyes; anthraquinone based dyes; quinophthalone based dyes; etc., can be enumerated. Concretely, for instance, red dyes such as MS Red G (manufactured by Mitsui Toatsu Chemicals, Inc.), Macrolex Red Violet R (manufactured by Bayer), and CeresRed 7B (manufactured by Bayer)), Samaron Red F3BS (manufactured by Mitsubishi Chemical corporation); yellow dyes such as Holon brilliant yellow 6 GL (manufactured by Clariant)), PTY-52 (manufactured by Mitsubishi kasei corp.), Macrolex yellow 6G (manufactured by Bayer)); and blue dyes such as Kayaset Blue 714 (manufactured by Nippon Kayaku Co., Ltd.), Waxoline Blue AP-FW (manufactured by ICI), Holon Brilliant Blue S-R (manufactured by Sandoz), MS blue 100 (manufactured by Mitsui Toatsu chemical Co., Ltd.), and C.I. solvent blue 22; are exemplified. The sublimable dye to be contained in each of the dye layers of the thermal transfer sheet of the embodiment is not limited at all by the exemplified material described above, and any other sublimation dye can be used.

With respect to the binder resin which is contained in the dye layer containing the releasing agent of the first group, concretely, the first dye layer (3Y) and the second dye layer (3M) in the thermal transfer sheet of the first mode, the first dye layer (3Y) in the thermal transfer sheet of the second mode, and the second dye layer (3M) in the thermal transfer sheet of the third mode, there is not particularly limitation, and a resin having a certain degree of heat resistance and having a moderate affinity with the sublimable dye can be used. As the binder, for example, cellulosic resin such as ethyl cellulose resin, hydroxyethyl cellulose resin, ethyl hydroxyethyl cellulose resin, methyl cellulose resin, cellulose acetate resin, etc.; vinyl based resin such as polyvinyl alcohol resin, polyvinyl acetate resin, polyvinyl butyral resin, polyvinyl acetal resin, polyvinyl pyrrolidone, etc.; acrylic resins such as poly (meth)acrylates, poly (meth)acryl amide, etc.; polyurethane based resins; polyester based resins; and the like may be enumerated. For example, it is possible that the dye layer contains the releasing agent of the first group and a cellulosic resin.

The content of the sublimable dye contained in the dye layer is not particularly limited, it may appropriately set according to the kinds of the sublimable dye and the binder resin to be used in consideration of the printing density and the preservation property and the like. For example, it is preferable that the content of the sublimable dye in each dye layer is in the range of not less than 15% by weight and not more than 300% by weight on the basis of the total weight of the solid content of the binder resin contained in each individual dye layer.

The respective dye layers may contain any of various additives such as inorganic fine particles, organic fine particles and the like, if desired. Examples of the inorganic fine particles include carbon black, aluminum, molybdenum disulfide and the like.

Further, the respective dye layers may include any of various kinds of curing agents such as isocyanates, epoxy resins, carbodiimide and the like. That is, a cured type binder resin obtained by curing a binder resin with a curing agent may be contained.

Although the thickness of each dye layer is not particularly limited, each of them is preferably to be about 0.2 μm to about 2.0 μm There is no particular limitation about the method for forming the first dye layer (3Y), the second dye layer (3M), and the third dye layer (3C). Each dye layer may be formed by dissolving or dispersing the sublimable dye, the binder resin, and optionally, any other ingredients, into a suitable solvent; coating thus prepared coating liquid onto the substrate 1 in accordance with a known coating procedure such as the gravure printing method, the reverse roll coating method using a gravure plate, roll coater, bar coater or the like; and then drying the coated liquid. At this time, either one of or both of the coating liquids for forming the first dye layer and the second dye layer contains the releasing agent of the first group. In a preferred embodiment, the coating liquid for forming a third dye layer is provided with a cellulosic resin.

(Substrate of Thermal Transfer Sheet)

The substrate 1 is not particularly limited, as far as it is the one which has a certain heat resistance and a certain strength, and it is possible to select one arbitrarily from materials known in the art. As the substrate 1, for instance, resin films such as polyethylene terephthalate film, 1,4-polycyclohexylene dimethylene terephthalate film, polyethylene naphthalate film, polyphenylene sulfide film, polystyrene film, polypropylene film, polysulfone film, aramide film, polycarbonate film, polyvinyl alcohol film, cellulose derivatives such as cellophane and cellulose acetate, polyethylene film, polyvinyl chloride film, nylon film, polyimide film, ionomer film, etc.; having a thickness of 0.5 μm to 50 μm, preferably, 1 μm to 10 μm, may be enumerated. Each of these materials can be used alone, and may be also used as a layered structure in combination with other materials.

The substrate 1 may undergo an adhesion treatment on the side on which the first dye layer (3Y), the second dye layer (3M) and the third dye layer (3C) will be formed. By the adhesion treatment, it become possible to improve the adhesiveness between the substrate 1 and the individual dye layers, or between the substrate 1 and an optional layer which may be provided between the substrate 1 and the individual dye layer.

As the adhesion treatment, it is possible to apply any known resin surface modifying techniques, such as corona discharge treatment, flame treatment, ozone treatment, ultraviolet treatment, radiation treatment, roughening treatment, chemical treatment, plasma treatment, grafting treatment, etc, as-is. These treatments may be performed may be performed in combination of two or more kinds.

(Dye Primer Layer)

Although the thermal transfer sheet in the embodiment shown in FIG. 1 takes a configuration where the first dye layer (3Y), the second dye layer (3M), and the third dye layer (3C) are directly contacted with one surface of the substrate 1, it is possible that a dye primer layer (not shown) may be provided between the substrate 1 and the dye layers (3Y, 3M, 3C). The dye primer layer is an arbitrary constituent in the thermal transfer sheet 10 of the one embodiment. By providing a dye primer layer, adhesion between the substrate 1 and each dye layer can be improved. Also, when a material having a low dye staining property is used as a dye primer layer, the printing density can be improved as compared to the case that the dye primer layer is not provided.

As the resin which constitutes the dye primer layer, for instance, polyester type resins, polyvinyl pyrrolidone resins, polyvinyl alcohol resins, hydroxyethyl celluloses, polyacrylic acid ester-based resins, polyvinyl acetate-based resins, polyurethane-based resins, styrene acrylate-based resins, polyacrylamide-based resins, polyamide-based resins, polyether-based resins, polystyrene-based resins, polyethylene-based resins, polypropylene-based resins, polyvinyl chloride resins, polyvinyl acetal-based resins such as polyvinyl acetoacetal and polyvinyl butyral, etc., may be enumerated.

The dye primer layer can also be composed of colloidal inorganic pigment ultrafine particles. According to this configuration, it is possible to prevent the sublimation dye from migrating from each dye layer to the dye primer layer side. Thereby, dye diffusion to the receiving layer side of the thermal transfer image receiving sheet can be effectively performed, an image having a high printing density can be formed.

Conventionally known compounds can be used as colloidal inorganic pigment ultrafine particles. For instance, silica (colloidal silica), alumina or alumina hydrate (alumina sol, colloidal alumina, cationic aluminum oxide or its hydrate, pseudo-boehmite, and the like), aluminum silicate, magnesium silicate, magnesium carbonate, magnesium oxide, and titanium oxide, etc., may be enumerated. In particular, colloidal silica and alumina sol are preferably used. As the particle size of these colloidal inorganic pigment ultrafine particles, it is preferable to be not more than 100 nm as the primary mean diameter, and preferably, not more than 50 nm as the primary mean diameter.

The dye primer layer may be formed by dissolving or dispersing the resin as indicated above, or the colloidal inorganic pigment ultrafine particles into a suitable solvent; coating thus prepared coating liquid for dye primer layer in accordance with a known coating procedure such as the gravure printing method, the roll coating method, the screen printing method, the reverse roll coating method using a gravure plate or the like; and then drying the coated liquid. It is preferable that the coating amount of the coating liquid for the dye primer layer is in the range of not less than 0.02 $g/m^2$ and not more than 1.0 $g/m^2$.

(Back Face Layer)

A back face layer 5 may be provided on another surface of the substrate 1. As a binder resin for forming the back face layer, there is no particular limitation, and it is possible to form the back face layer by selecting appropriately one resin from conventionally known thermoplastic resins and the like. As the thermoplastic resin, for instance, thermoplastic resins such as polyester type resins, polyacrylic ester type resins, polyvinyl acetate type resins, styrene acrylate type resins, polyurethane type resins, polyolefin type resins such as polyethylene type resins and polypropylene type resins, polystyrene type resins, polyvinyl chloride type resins, polyether type resins, polyamide type resins, polyimide type resins, polyamide-imide type resins, polycarbonate type resins, polyacrylamide type resins, polyvinyl chloride resins, polyvinyl butyral resins, and polyvinyl acetal resins; and silicone-modified forms of these thermoplastic resins may be enumerated.

In addition, it is preferable that a lubricant for improving the slipping property with the thermal head is contained in the back face layer 5. The lubricant is an optional constituent in the back layer 5. As the lubricant, for instance, multivalent metallic salts of alkyl phosphoric esters, phosphoric esters, fatty acid esters, metal soaps, waxes, graphite powders, fluorine-modified graft polymers, fluorine-modified block polymers, silicone oil, silicone polymers such as silicone-modified graft polymers, silicone-modified block polymers, etc., may be used by an appropriately selection. Among the lubricant components, phosphoric esters, fatty acid esters, metal soaps, and waxes can be used particularly preferably in the present invention.

As the metal soaps, for instance, multivalent metallic salts of fatty acids, metallic salts of alkyl carboxylic acid may be enumerated. As the metal soaps, the ones which are known in the art as additive for plastics may be used. Among them, zinc stearate and/or zinc stearyl phosphate can be preferably used in the present invention As the phosphate ester, those which are described above as one types of the releasing agent of the first group may be used by an appropriately selection.

There is no particular limitation about the method for forming the back face layer 5. The back face layer 5 may be formed by dissolving or dispersing the binder resin, and optionally, other ingredients such as lubricant into a suitable solvent; coating thus prepared coating liquid onto the substrate 1 in accordance with a known coating procedure such as the gravure printing method, the screen printing method, the reverse roll coating method using a gravure plate, or the like; and then drying the coated liquid. As the solvent to be used for preparing the coating liquid, for instance, water, toluene, methyl ethyl ketone, ethanol, isopropyl alcohol, cyclohexane, dimethyl formamide, ethyl acetate, etc., can be enumerated.

(Back Face Primer Layer)

Further, a back face primer layer (not shown) can also be provided between the substrate sheet 1 and the back face layer 5. The back face primer layer is a layer provided for improving the adhesiveness between the substrate sheet 1 and the back surface layer 5, and it is an optional layer. As the back face primer layer, for example, polyester resins, polyurethane resins, acrylic resins, polycarbonate resins, polyimide resins, polyimide resins, polyamideimide resins, vinyl chloride-vinyl acetate copolymers, polyvinyl butyral resins, polyvinyl alcohol resins, polyvinyl pyrrolidone resins and the like may be enumerated.

The thermal transfer sheet 10 of the present invention is fairly explained as above. However, without deviating from the scope and the spirit of the first embodiment of the present invention, the thermal transfer sheet can takes various modified embodiments other than the ones as disclosed above. For example, in the constitution shown in FIG. 1, it is possible to provide each individual dye layers and a transferable protective layer (not shown) are provided on the same surface of the substrate sheet 1 as being frame sequentially in order to manufacture an integral type thermal transfer sheet. In addition, it is also possible to provide a release layer may be provided between the substrate 1 and the transferable protective layer.

In the above, although the adhesiveness between the image and the protective layer when the protective layer is transferred onto the "tertiary color image" is mainly described, according to the thermal transfer sheet of one embodiment, it is possible to form the "tertiary color image" having good adhesion to any object other than the protective layer, and to any image, can be formed. For example, it is possible to form the "tertiary color image" having good adhesion to a black image formed by melting and transferring a melted black colored layer. When a "tertiary color image" is formed on a receiving layer of the intermediate transfer medium, and the receiving layer on which the "tertiary color image" has been formed is transferred to an object to which the image is transferred, such as a card substrate or the like, it is also possible to improve the adhesiveness between the receiving layer and the card substrate or the like.

In the above, although the case that the respective color images are formed on the receiving layer of the thermal transfer image-receiving sheet is mainly described, there is no particular limitation on the article to which the image is transferred for forming the image of each color. For example, an intermediate transfer medium having a transferable receiving layer may be used in place of the thermal transfer image receiving sheet. With respect to the image formation onto a receiving layer of an intermediate transfer medium using a thermal transfer sheet 10 of one embodiment, it is possible to transfer the receiving layer of the intermediate transfer medium onto the article to which the image is to be transferred, and then the image may be formed on the transferred receiving layer. Alternatively, it is also possible to form an image on the receiving layer of the intermediate transfer medium, and then to transfer the receiving layer on which the image has been formed to the article to which the image is to be transferred. As the article to which the receiving layer of the intermediate transfer medium is transferred, for instance, a plain paper, a high quality paper, a tracing paper, a plastic film, and the like may be enumerated. As the thermal transfer image receiving sheet, any conventionally known thermal transfer image receiving sheet in which a receiving layer is provided on one surface of another substrate can be used by an appropriately selection.

In particular, according to the present invention, a countermeasure is taken to improve the releasability at the time of image formation, the image forming can be performed with good releasability on the article to which the image is to be transferred, for instance, the receiving layer, regardless the kind of the material of the receiving layer.

Furthermore in the above, although the case that sublimation type thermal transfer sheet in which the first dye layer, the second dye layer and the third dye layer are provided on the substrate in this order as being frame sequentially is described, sublimable type thermal transfer sheet may take a configuration that a first dye layer, a second dye layer, a third dye layer, - - -, a $(n-1)^{th}$ dye layer, and a $n^{th}$ dye layer are provided in this order as being frame sequentially. In this case, the $n^{th}$ dye should satisfy the conditions of the third dye layer as described above, and the other dye layers should satisfy the conditions of the first dye layer and the second dye as mentioned above. By virtue of the sublimation type thermal transfer sheet in this case, it is also possible to form an image having good adhesion with the protective layer or the like, and to attain a good releasability of the dye layer at the time of image formation.

EXAMPLES

Now, the present invention will be described more specifically by Way of examples. Hereinafter, the expressions of "part(s)" and "%" are based on "weight", unless otherwise especially mentioned. The expressions "part(s)" and "%" are those of solid content, unless otherwise especially mentioned. Further, "Mn" conforms to JIS K 7252-1: 2008, and means the number average molecular weight in terms of polystyrene, determined by gel permeation chromatography (GPC). "Tg" conforms to JIS K7121: 2012, and means a glass transition temperature, determined based on measurement of changes in heat quantity by DSC (differential scanning calorimetry) (DSC method).

<Coating Liquid for Yellow Dye Layer 1>

| | |
|---|---|
| Yellow dye represented by the following general formula (1) | 6.0 parts |
| Polyvinyl acetoacetal resin (KS-5, manufactured by Sekisui Chemical Co., Ltd.) | 4.0 parts |
| Silicone oil (X-22-3939, manufactured by Shin-etsu Chemical Co., Ltd.) | 0.1 part |
| Toluene | 45 parts |
| Methyl ethyl ketone | 45 parts |

General Formula (1)

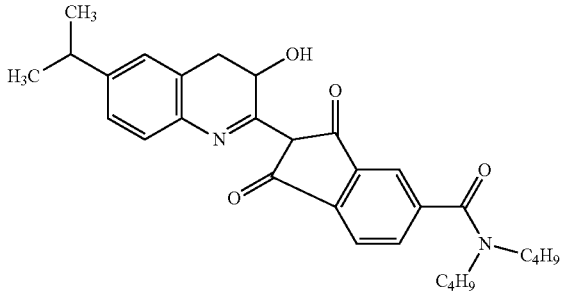

<Coating Liquid for Yellow Dye Layer 2>

| | |
|---|---|
| Yellow dye represented by the above general formula (1) | 6.0 parts |
| Polyvinyl acetoacetal resin (KS-5, manufactured by Sekisui Chemical Co., Ltd.) | 4.0 parts |
| Silicone oil (X-22-3939, manufactured by Shin-etsu Chemical Co., Ltd.) | 0.15 part |
| Toluene | 45 parts |
| Methyl ethyl ketone | 45 parts |

<Coating Liquid for Yellow Dye Layer 3>

| | |
|---|---|
| Yellow dye represented by the above general formula (1) | 6.0 parts |
| Polyvinyl acetoacetal resin (KS-5, manufactured by Sekisui Chemical Co., Ltd.) | 4.0 parts |
| Phosphate ester (PLYSURF A208N, manufactured by Dai-ichi Kogyo Seiyaku Co., Ltd.) | 0.06 part |
| Toluene | 45 parts |
| Methyl ethyl ketone | 45 parts |

<Coating Liquid for Yellow Dye Layer 4>

| | |
|---|---|
| Yellow dye represented by the above general formula (1) | 6.0 parts |
| Polyvinyl acetoacetal resin | 4.0 parts |
| (KS-5, manufactured by Sekisui Chemical Co., Ltd.) | |
| Silicone oil | 0.5 part |
| (X-22-3939, manufactured by Shin-etsu Chemical Co., Ltd.) | |
| Phosphate ester | 0.04 part |
| (PLYSURF A208N, manufactured by Dai-ichi Kogyo Seiyaku Co., Ltd.) | |
| Toluene | 45 parts |
| Methyl ethyl ketone | 45 parts |

<Coating Liquid for Yellow Dye Layer 5>

| | |
|---|---|
| Yellow dye represented by the above general formula (1) | 6.0 parts |
| Polyvinyl acetoacetal resin | 3.6 parts |
| (KS-5, manufactured by Sekisui Chemical Co., Ltd.) | |
| Ethyl cellulose resin (ethoxyl group content: 45%) | 0.4 part |
| (ETHOCEL STD45, manufactured by Nissin Chemical Industry Co., Ltd.) | |
| Toluene | 45 parts |
| Methyl ethyl ketone | 45 parts |

<Coating Liquid for Yellow Dye Layer 6>

| | |
|---|---|
| Yellow dye represented by the above general formula (1) | 6.0 parts |
| Polyvinyl acetoacetal resin | 4.0 parts |
| (KS-5, manufactured by Sekisui Chemical Co., Ltd.) | |
| Toluene | 45 parts |
| Methyl ethyl ketone | 45 parts |

<Coating Liquid for Yellow Dye Layer 7>

| | |
|---|---|
| Yellow dye represented by the above general formula (1) | 6.0 parts |
| Polyvinyl acetoacetal resin | 4.0 parts |
| (KS-5, manufactured by Sekisui Chemical Co., Ltd.) | |
| Silicone modified acrylic resin (solid content: 15%) | 5.0 parts |
| (FS-720, manufactured by NOF Corporation) | |
| Toluene | 45 parts |
| Methyl ethyl ketone | 45 parts |

<Coating Liquid for Magenta Layer 1>

| | |
|---|---|
| Magenta dye represented by the following general formula (2) | 7.0 parts |
| Polyvinyl acetoacetal resin | 7.0 parts |
| (KS-5, manufactured by Sekisui Chemical Co., Ltd.) | |
| Silicone oil | 1.4 parts |
| (X-22-3939, manufactured by Shin-etsu Chemical Co., Ltd.) | |
| Toluene | 45 parts |
| Methyl ethyl ketone | 45 parts |

General Formula (2)

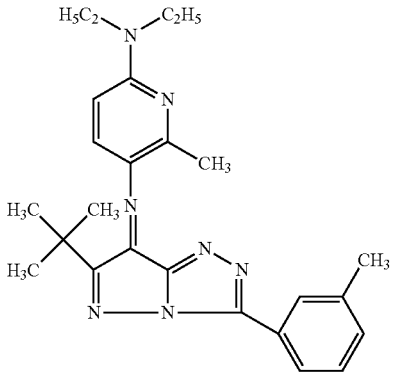

<Coating Liquid for Magenta Dye Layer 2>

| | |
|---|---|
| Magenta dye represented by the above general formula (2) | 7.0 parts |
| Polyvinyl acetoacetal resin | 7.0 parts |
| (KS-5, manufactured by Sekisui Chemical Co., Ltd.) | |
| Silicone oil | 1.0 part |
| (X-22-3939, manufactured by Shin-etsu Chemical Co., Ltd.) | |
| Toluene | 45 parts |
| Methyl ethyl ketone | 45 parts |

<Coating Liquid for Magenta Layer 3>

| | |
|---|---|
| Magenta dye represented by the above general formula (2) | 7.0 parts |
| Polyvinyl acetoacetal resin | 7.0 parts |
| (KS-5, manufactured by Sekisui Chemical Co., Ltd.) | |
| Phosphate ester | 0.11 part |
| (PLYSURF A208N, manufactured by Dai-ichi Kogyo Seiyaku Co., Ltd.) | |
| Toluene | 45 parts |
| Methyl ethyl ketone | 45 parts |

<Coating Liquid for Magenta Dye Layer 4>

| | |
|---|---|
| Magenta dye represented by the above general formula (2) | 7.0 parts |
| Polyvinyl acetoacetal resin | 7.0 parts |
| (KS-5, manufactured by Sekisui Chemical Co., Ltd.) | |
| Silicone oil | 1.0 part |
| (X-22-3939, manufactured by Shin-etsu Chemical Co., Ltd.) | |
| Phosphate ester | 0.06 part |
| (PLYSURF A208N, manufactured by Dai-ichi Kogyo Seiyaku Co., Ltd.) | |
| Toluene | 45 parts |
| Methyl ethyl ketone | 45 parts |

<Coating Liquid for Magenta Dye Layer 5>

| | |
|---|---|
| Magenta dye represented by the above general formula (2) | 7.0 parts |
| Polyvinyl acetoacetal resin | 6.3 parts |
| (KS-5, manufactured by Sekisui Chemical Co., Ltd.) | |
| Ethyl cellulose resin (ethoxyl group content: 45%) | 0.7 part |
| (ETHOCEL STD45, manufactured by Nissin Chemical Industry Co., Ltd .) | |
| Toluene | 45 parts |
| Methyl ethyl ketone | 45 parts |

<Coating Liquid for Magenta Dye Layer 6>

| | |
|---|---|
| Magenta dye represented by the above general formula (2) | 7.0 parts |
| Polyvinyl acetoacetal resin (KS-5, manufactured by Sekisui Chemical Co., Ltd.) | 4.2 parts |
| Polyvinyl butyral resin (Mn: about 66000, Tg: 64° C.) (S-LEC BH-S, manufactured by Sekisui Chemical Co., Ltd.) | 2.1 Parts |
| Ethyl cellulose resin (ethoxyl group content: 45%) (ETHOCEL STD45, manufactured by Nissin Chemical Industry Co., Ltd.) | 0.7 part |
| Toluene | 45 parts |
| Methyl ethyl ketone | 45 parts |

<Coating Liquid for Magenta Dye Layer 7>

| | |
|---|---|
| Magenta dye represented by the above general formula (2) | 7.0 parts |
| Polyvinyl acetoacetal resin (KS-5, manufactured by Sekisui Chemical Co., Ltd.) | 4.2 parts |
| Polyvinyl butyral resin (Mn: about 66000, Tg: 64° C.) (S-LEC BH-S, manufactured by Sekisui Chemical Co., Ltd.) | 2.8 Parts |
| Toluene | 45 parts |
| Methyl ethyl ketone | 45 parts |

<Coating Liquid for Magenta Dye Layer 8>

| | |
|---|---|
| Magenta dye represented by the above general formula (2) | 7.0 parts |
| Polyvinyl acetoacetal resin (KS-5, manufactured by Sekisui Chemical Co., Ltd.) | 7.0 parts |
| Toluene | 45 parts |
| Methyl ethyl ketone | 45 parts |

<Coating Liquid for Magenta Dye Layer 9>

| | |
|---|---|
| Magenta dye represented by the above general formula (2) | 7.0 parts |
| Polyvinyl acetoacetal resin (KS-5, manufactured by Sekisui Chemical Co., Ltd.) | 7.0 parts |
| Silicone modified acrylic resin (solid content: 15%) (FS-720, manufactured by NOF Corporation) | 8.75 parts |
| Toluene | 45 parts |
| Methyl ethyl ketone | 45 parts |

<Coating Liquid for Cyan Dye Layer 1>

| | |
|---|---|
| Cyan dye represented by the following general formula (3) | 5.0 parts |
| Polyvinyl acetoacetal resin (KS-5, manufactured by Sekisui Chemical Co., Ltd.) | 5.0 parts |
| Silicone oil (X-22-3939, manufactured by Shin-etsu Chemical Co., Ltd.) | 0.1 parts |
| Toluene | 45 parts |
| Methyl ethyl ketone | 45 parts |

General formula (3)

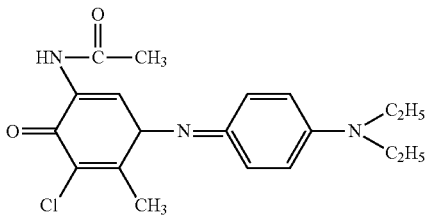

<Coating Liquid for Cyan Dye Layer 2>

| | |
|---|---|
| Cyan dye represented by the above general formula (3) | 5.0 parts |
| Polyvinyl acetoacetal resin (KS-5, manufactured by Sekisui Chemical Co., Ltd.) | 5.0 parts |
| Silicone oil (X-22-3939, manufactured by Shin-etsu Chemical Co., Ltd.) | 0.15 parts |
| Toluene | 45 parts |
| Methyl ethyl ketone | 45 parts |

<Coating Liquid for Cyan Dye Layer 3>

| | |
|---|---|
| Cyan dye represented by the above general formula (3) | 5.0 parts |
| Polyvinyl acetoacetal resin (KS-5, manufactured by Sekisui Chemical Co., Ltd.) | 5.0 parts |
| Phosphate ester (PLYSURF A208N, manufactured by Dai-ichi Kogyo Seiyaku Co., Ltd.) | 0.06 part |
| Toluene | 45 parts |
| Methyl ethyl ketone | 45 parts |

<Coating Liquid for Cyan Dye Layer 4>

| | |
|---|---|
| Cyan dye represented by the above general formula (3) | 5.0 parts |
| Polyvinyl acetoacetal resin (KS-5, manufactured by Sekisui Chemical Co., Ltd.) | 2.5 parts |
| Polyvinyl butyral resin (Mn: about 66000, Tg: 64° C.) (S-LEC BH-S, manufactured by Sekisui Chemical Co., Ltd.) | 2.5 Parts |
| Silicone oil (X-22-3939, manufactured by Shin-etsu Chemical Co., Ltd.) | 0.02 part |
| Toluene | 45 parts |
| Methyl ethyl ketone | 45 parts |

<Coating Liquid for Cyan Dye Layer 5>

| | |
|---|---|
| Cyan dye represented by the above general formula (3) | 5.0 parts |
| Polyvinyl acetoacetal resin (KS-5, manufactured by Sekisui Chemical Co., Ltd.) | 4.5 parts |
| Ethyl cellulose resin (ethoxyl group content: 45%) (ETHOCEL STD45, manufactured by Nissin Chemical Industry Co., Ltd.) | 0.5 part |
| Toluene | 45 parts |
| Methyl ethyl ketone | 45 parts |

<Coating Liquid for Cyan Dye Layer 6>

| | |
|---|---|
| Cyan dye represented by the above general formula (3) | 5.0 parts |
| Polyvinyl acetoacetal resin (KS-5, manufactured by Sekisui Chemical Co., Ltd.) | 3.0 parts |
| Polyvinyl butyral resin (Mn: about 66000, Tg: 64° C.) (S-LEC BH-S, manufactured by Sekisui Chemical Co., Ltd.) | 1.5 Parts |
| Ethyl cellulose resin (ethoxyl group content: 45%) (ETHOCEL STD45, manufactured by Nissin Chemical Industry Co., Ltd.) | 0.5 part |
| Toluene | 45 parts |
| Methyl ethyl ketone | 45 parts |

<Coating Liquid for Cyan Dye Layer 7>

| | |
|---|---|
| Cyan dye represented by the above general formula (3) | 5.0 parts |
| Polyvinyl acetoacetal resin (KS-5, manufactured by Sekisui Chemical Co., Ltd.) | 3.0 parts |
| Polyvinyl butyral resin (Mn: about 66000, Tg: 64° C.) | 2.0 Parts |

-continued

| | |
|---|---|
| (S-LEC BH-S, manufactured by Sekisui Chemical Co., Ltd.) | |
| Toluene | 45 parts |
| Methyl ethyl ketone | 45 parts |

<Coating Liquid for Cyan Dye Layer 8>

| | |
|---|---|
| Cyan dye represented by the above general formula (3) | 5.0 parts |
| Polyvinyl acetoacetal resin (KS-5, manufactured by Sekisui Chemical Co., Ltd.) | 5.0 parts |
| Toluene | 45 parts |
| Methyl ethyl ketone | 45 parts |

<Coating Liquid for Cyan Dye Layer 9>

| | |
|---|---|
| Cyan dye represented by the above general formula (3) | 5.0 parts |
| Cellulose acetate propionate resin (CAP482-20, manufactured by Eastman Chemical Japan Co., Ltd.) | 5.0 parts |
| Toluene | 45 parts |
| Methyl ethyl ketone | 45 parts |

Example 1

As a substrate, polyethylene terephthalate film which underwent easy-adhesive treatment in advance, and has 4.5 μm in thickness was used. On this substrate, a coating liquid for back face layer having the following composition was coated so as to obtain a coating amount of 0.8 g/m$^2$ in the dried state and thereby, a back face layer was formed. Then, on a part of another surface side of the substrate, a coating liquid for yellow dye layer 1 having the above-mentioned composition, a coating liquid for magenta dye layer 6 having the above-mentioned composition, and a coating liquid for cyan dye layer 6 having the above-mentioned composition were coated so as to obtain each individual coating amount of 0.6 g/m$^2$ in the dried state, through a repeated face-by-face operation for each color in this order in order to form yellow dye layer, magenta dye layer and cyan dye layer, respectively. Ultimately, a thermal transfer sheet of Example 1 was prepared.

<Coating Liquid for Back Face Layer>

| | |
|---|---|
| Polyvinyl butyral resin (S-LEC BX-1, manufactured by Sekisui Chemical Co., Ltd.) | 2.0 parts |
| Polyisocyanate (BURNOCK D750, manufactured by DIC Corporation) | 9.2 parts |
| Phosphate ester type surfactant (PLYSURF A208N, manufactured by Dai-ichi Kogyo Seiyaku Co., Ltd.) | 1.3 parts |
| Talc (MICRO ACE P-3, manufactured by Nippon Talc Co., Ltd.) | 0.3 part |
| toluene | 43.6 parts |
| methyl ethyl ketone | 43.6 parts |

Examples 2-16 and Comparative Examples 1-6

Thermal transfer sheets of Examples 2-16 and Comparative examples 1-6 were obtained by carrying out the same procedure in Example 1 except that the coating liquid for yellow dye layer 1 and the coating liquid for magenta dye layer 6 and the coating liquid for cyan dye layer 6 were replaced individually by the coating liquids shown in the following Table 1.

TABLE 1

| | Coating liquid for yellow dye layer | Coating liquid for magenta dye layer | Coating liquid for cyan dye layer |
|---|---|---|---|
| Example 1 | 1 | 6 | 6 |
| Example 2 | 3 | 6 | 6 |
| Example 3 | 5 | 1 | 5 |
| Example 4 | 5 | 3 | 5 |
| Example 5 | 1 | 1 | 5 |
| Example 6 | 3 | 3 | 5 |
| Example 7 | 3 | 3 | 7 |
| Example 8 | 1 | 1 | 7 |
| Example 9 | 1 | 1 | 4 |
| Example 10 | 1 | 6 | 4 |
| Example 11 | 1 | 1 | 6 |
| Example 12 | 1 | 3 | 6 |
| Example 13 | 4 | 4 | 6 |
| Example 14 | 7 | 9 | 6 |
| Example 15 | 3 | 3 | 9 |
| Example 16 | 7 | 5 | 5 |
| Comparative example 1 | 2 | 2 | 2 |
| Comparative example 2 | 3 | 3 | 3 |
| Comparative example 3 | 5 | 5 | 5 |
| Comparative example 4 | 6 | 8 | 8 |
| Comparative example 5 | 6 | 8 | 1 |
| Comparative example 6 | 5 | 7 | 7 |

(Evaluation of Releasability)

The thermal transfer sheets of Examples and Comparative examples prepared above were used, and the releasability when forming a primary color image, a secondary color image and a tertiary color image onto a white polyvinyl chloride resin card that was prepared with the following composition were evaluated in accordance with the following criteria. The evaluation results are shown in Table 2. Here, the primary color image was the image (yellow image) formed on the thermal transfer image-receiving sheet by using a yellow dye layer, and the releasability when forming the primary color image was the releasability between the receiving layer of the thermal transfer image-receiving sheet and the yellow dye layer. The secondary color image was the image (red image) formed by superposing a magenta image on the primary color image with using the magenta day layer, and the releasability when forming the secondary color image was the releasability between the primary color image and the magenta dye layer. The tertiary color image was the image (black image) formed by superposing a cyan image on the secondary color image with using the cyan dye layer, and the releasability when forming the tertiary color image was the releasability between the secondary color image and the cyan dye layer. The formation of each image was performed by using the following test printer and with the condition of 0/255 gradation image (black solid).

(Material Composition of Card Substrate)

| | |
|---|---|
| Polyvinyl chloride compound (polymerization degree: 800) (containing about 10% of additives such as stabilizer) | 100 parts |

-continued

| | |
|---|---|
| white pigment (titanium oxide) | 10 parts |
| plasticizer (DOP) | 0.5 part |

(Test Printer)
Thermal head: KEE-57-12GAN2-STA (manufactured by Kyocera Co., Ltd.)
Average resistance of heating element: 3303 (Ω)
Print density in main scanning direction: 300 dpi
Print density in sub scanning direction: 300 dpi
Applied voltage: 18 V
1-line period: 1.5 (msec.)
Pulse Duty rate: 85%
<Evaluation Criteria>
◎: No peeling mark was observed in both of the dye layers and the formed image, and there is no problem in the formed image.
○: Although peeling marks were slightly observed in the dye layers and the formed image, but there is no problem in the formed image.
Δ: Although peeling marks were certainly observed in the dye layers and the formed image, but there is no problem in use of the formed image.
x: Many peeling marks were observed in the dye layers and the formed image, and there are problems in use of the formed image.
(Evaluation of Adhesiveness of Protective Layer)

On to the tertiary color image formed on the white polyvinyl chloride card in the above-mentioned releasability evaluation, a protective layer of a protective layer transfer sheet formed by the following procedure was transferred. Next, the white polyvinyl chloride card on which the protective layer had been transferred was immersed in ethanol for 24 hours, and then a tape peeling test was carried out by using a Scotch Tape, and the adhesiveness of the protective layer were evaluated in accordance with the following criteria. The evaluation results are also shown in Table 2. Here, the transfer of the protective layer was carried out by using the test printer used in the formation of image in the above-mentioned releasability evaluation, and with the condition of 30/255 gradation image (deep gray).
(Preparation of Protective Layer Transfer Sheet)

As a substrate, polyethylene terephthalate film which has 4.5 μm in thickness was used. On this substrate, a coating liquid for protective layer having the following composition was coated so as to obtain a coating amount of 1.0 g/m$^2$ in the dried state and thereby, a protective layer was formed. Then, on the formed protective layer, a coating liquid for adhesive layer having the following composition was coated so as to obtain a coating amount of 1.0 g/m$^2$ in the dried state, and thereby an adhesive layer was formed. Ultimately, a protective layer transfer sheet 1 was prepared.
<Coating Liquid for Protective Layer>

| | |
|---|---|
| Acrylic resin (BR - 83, manufactured by Mitsubishi Rayon Co., Ltd.) | 19.5 parts |
| Polyester resin (Vylon 200, manufactured by Toyobo Co., Ltd.) | 0.5 parts |
| Toluene | 40 parts |
| Methyl ethyl ketone | 40 parts |

<Coating Liquid for Adhesive Layer>

| | |
|---|---|
| Polyester resin (Vylon 200, manufactured by Toyobo Co., Ltd.) | 20 parts |

-continued

| | |
|---|---|
| Toluene | 40 parts |
| Methyl ethyl ketone | 40 parts |

<Evaluation Criteria>
◎: No peeling off
○: Peeling off at a little dot level
Δ: partial peeling off (more than dot level)
x: complete peeling off

TABLE 2

| | Adhesiveness of protective layer | Releasability at first color image formation | Releasability at second color image formation | Releasability at third color image formation |
|---|---|---|---|---|
| Example 1 | ◎ | ◎ | ◎ | ○ |
| Example 2 | ◎ | ◎ | ◎ | ○ |
| Example 3 | ◎ | ◎ | ◎ | ◎ |
| Example 4 | ◎ | ◎ | ◎ | ◎ |
| Example 5 | ○ | ◎ | ◎ | ◎ |
| Example 6 | ○ | ◎ | ◎ | ◎ |
| Example 7 | ○ | ◎ | ◎ | ○ |
| Example 8 | ○ | ◎ | ◎ | ○ |
| Example 9 | Δ | ◎ | ◎ | ◎ |
| Example 10 | ○ | ◎ | ◎ | ○ |
| Example 11 | ○ | ◎ | ◎ | ◎ |
| Example 12 | ○ | ◎ | ◎ | ◎ |
| Example 13 | ○ | ◎ | ◎ | ◎ |
| Example 14 | ○ | ◎ | ◎ | ◎ |
| Example 15 | ○ | ◎ | ◎ | ○ |
| Example 16 | ◎ | ◎ | ◎ | ◎ |
| Comparative Example 1 | X | ◎ | ◎ | ◎ |
| Comparative Example 2 | X | ◎ | ◎ | ◎ |
| Comparative Example 3 | ○ | ◎ | ○ | X |
| Comparative Example 4 | ○ | Δ | X | X |
| Comparative Example 5 | X | Δ | X | ○ |
| Comparative Example 6 | ◎ | Δ | X | X |

EXPLANATION OF THE NUMERALS

1 . . . substrate
3Y . . . first dye layer
3M . . . second dye layer
3C . . . third dye layer
5 . . . back-face layer
10 . . . Thermal transfer sheet

The invention claimed is:

1. A sublimation type thermal transfer sheet comprising:
a substrate;
a yellow dye layer;
a magenta dye layer;
a cyan dye layer; and
a back face layer;
wherein the yellow dye layer, the magenta dye layer, and the cyan dye layer are frame sequentially formed on a surface of the substrate in this order;
wherein the back face layer is formed on another surface of the substrate;
wherein the yellow dye layer, the magenta dye layer, and the cyan dye layer each contain an individual sublimable dye and an individual binder resin;

wherein one of the yellow dye layer and the magenta dye layer further contain a releasing agent selected from the group consisting of silicone oils, silicone-modified resins and phosphoric esters, and the other of the yellow dye layer and the magenta dye layer further contain an alkyl cellulose resin; and wherein the cyan dye layer further contains an alkyl cellulose resin.

* * * * *